US009315347B2

(12) United States Patent
Hamada et al.

(10) Patent No.: US 9,315,347 B2
(45) Date of Patent: Apr. 19, 2016

(54) PAPER SUPPLY DEVICE

(71) Applicants: Masataka Hamada, Fuefuki (JP); Junya Nakajima, Minamialps (JP); Koji Kanda, Kai (JP)

(72) Inventors: Masataka Hamada, Fuefuki (JP); Junya Nakajima, Minamialps (JP); Koji Kanda, Kai (JP)

(73) Assignees: XEROX CORPORATION, Norwalk, CT (US); NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/424,301

(22) PCT Filed: Aug. 23, 2013

(86) PCT No.: PCT/JP2013/072565

§ 371 (c)(1),
(2) Date: Feb. 26, 2015

(87) PCT Pub. No.: WO2014/034562

PCT Pub. Date: Mar. 6, 2014

(65) Prior Publication Data

US 2015/0217952 A1 Aug. 6, 2015

(30) Foreign Application Priority Data

Aug. 27, 2012 (JP) ..... 2012-186057

(51) Int. Cl.
*B65H 1/14* (2006.01)
*B65H 1/04* (2006.01)
(Continued)

(52) U.S. Cl.
CPC .. *B65H 1/14* (2013.01); *B65H 1/04* (2013.01); *B65H 3/0684* (2013.01); *B65H 3/34* (2013.01);
(Continued)

(58) Field of Classification Search
CPC ..... B65H 1/18; B65H 3/0684; B65H 2405/1134; B65H 7/02; B65H 1/08; B65H 1/14
See application file for complete search history.

(56) References Cited

U.S. PATENT DOCUMENTS 5,988,628 A 11/1999 Mori
7,753,366 B2 * 7/2010 Kawanishi ..... B65H 1/18 27/152

(Continued)

FOREIGN PATENT DOCUMENTS

JP S63-041332 A 2/1988
JP 2000-095359 A 4/2000
JP 2002-060067 A 2/2002
JP 2003-118851 A 4/2003
JP 2010-228848 A 10/2010

OTHER PUBLICATIONS

PCT, "International Search Report for International Application No. PCT/JP2013/072565".

*Primary Examiner* — Jeremy R Severson
(74) *Attorney, Agent, or Firm* — Manabu Kanesaka

(57) ABSTRACT

A sheet supply device includes a sheet supply tray, a delivery roller contacting a topmost surface of a sheet bundle on the sheet supply tray to deliver the sheet, and separation means feeding the sheet delivered by the delivery roller one by one in a separated manner. The sheet supply device further includes an elevating tray freely elevated/lowered to support a leading end side of the sheet bundle placed on the sheet supply tray and to move the topmost surface of the sheet bundle to a delivery position, a first drive section elevating/lowering the elevating tray, a second drive section elevating/lowering the delivery roller, and a controller controlling the first and second drive sections to elevate the elevating tray until the topmost surface of the sheet bundle reaches the delivery position and thereafter lower the delivery roller to a position contacting the topmost surface of the sheet bundle.

8 Claims, 9 Drawing Sheets

(51) Int. Cl.

| | |
|---|---|
| ***B65H 3/06*** | (2006.01) |
| ***B65H 7/02*** | (2006.01) |
| ***B65H 7/20*** | (2006.01) |
| ***B65H 3/34*** | (2006.01) |
| ***B65H 7/06*** | (2006.01) |

(52) U.S. Cl.

CPC .. *B65H 7/02* (2013.01); *B65H 7/06* (2013.01); *B65H 7/20* (2013.01); *B65H 2301/4222* (2013.01); *B65H 2405/1117* (2013.01); *B65H 2511/51* (2013.01); *B65H 2511/515* (2013.01); *B65H 2513/40* (2013.01); *B65H 2513/51* (2013.01); *B65H 2801/06* (2013.01); *B65H 2801/39* (2013.01)

(56) References Cited

U.S. PATENT DOCUMENTS

| | | | | |
|---|---|---|---|---|
| 7,971,868 | B2 * | 7/2011 | Matsushima et al. | 271/118 |
| 2008/0197560 | A1 * | 8/2008 | Lee et al. | 271/121 |
| 2013/0215481 | A1 * | 8/2013 | Hayasaka | G03G 15/607 358/498 |
| 2014/0008867 | A1 * | 1/2014 | Ohtani | B65H 1/04 271/265.01 |
| 2014/0103602 | A1 * | 4/2014 | Blair et al. | 271/117 |
| 2015/0151935 | A1 * | 6/2015 | Murakami et al. | 271/117 |

* cited by examiner

PAPER SUPPLY DEVICE

RELATED APPLICATIONS

The present application is National Phase of International Application No. PCT/JP2013/072565 filed Aug. 23, 2013, and claims priority from Japanese Application No. 2012-186057, filed Aug. 27, 2012, the disclosure of which is hereby incorporated by reference herein in its entirety.

TECHNICAL FIELD

The present invention relates to a sheet supply device that feeds a sheet to a predetermined reading position and, more particularly, to a configuration that delivers a sheet placed on a sheet supply tray.

BACKGROUND ART

Conventionally, there are well-known a sheet supply device provided in a copier or a printer and configured to feed a sheet to an image forming section that forms an image on the sheet and a sheet supply device provided in an image reading device, such as a copier, a facsimile machine, or an image scanner and configured to feed a sheet (document) to a predetermined reading position. As a specific example of such a sheet supply device, there is known one configured to deliver a sheet on the sheet supply tray by means of a delivery roller, convey the delivered sheet to the reading position one by one by means of a separation section including a feeding roller and a separation member, and feed the read sheet to a sheet discharge tray.

Among such sheet supply devices, there is known, in a device of a type capable of handling a large volume of sheets (50 sheets or more), a sheet supply device provided with an elevating tray that elevates a downstream side of sheets placed on the sheet supply tray to bring a topmost surface of the sheet bundle into abutment against a peripheral surface of a delivery roller suspended by its own weight (see, for example, Patent Document 1). The elevating tray supports the downstream side of the sheets placed on the sheet supply tray separately from the sheet supply tray and is configured to turn about an upstream side end portion thereof by means of an actuator such as a motor or a solenoid. The elevating tray turns from a set position where a document is set to a delivery position where the topmost surface of the sheet bundle placed on the elevating tray abuts against the delivery roller.

A sheet feed operation in the sheet supply device provided with such an elevating tray is as follows. The elevating tray turns, in response to a sheet feed signal, in such a direction that the downstream side thereof is elevated to elevate the leading end side (downstream side end portion in a sheet conveying direction) of the sheet. When the topmost surface of the sheet bundle reaches the delivery position abutting against the delivery roller, the turning of the elevating tray is stopped. Then, the sheet is delivered by means of the delivery roller. The delivered sheet is conveyed one by one by the separation section to the reading position. When feeding of all the sheets on the sheet supply tray is completed, the elevating tray turns downward in a reverse direction until the downstream side thereof reaches the set position where the sheet can be placed on the sheet supply tray.

CITATION LIST

Patent Document

[Patent Document 1] Jpn. Pat. Appln. Laid-Open Publication No. 2003-118851

DISCLOSURE OF THE INVENTION

Problems to be Solved by the Invention

However, in the conventional sheet supply device, it is necessary to set the sheets on the sheet supply tray in a state where the delivery roller is suspended by its own weight to a position lower in height than the delivery position. This correspondingly limits the number of sheets that can be loaded on the sheet supply tray.

Further, in the conventional sheet supply device, when the maximum loading number of sheets to be loaded on the sheet supply tray is made large, it is necessary to increase a depth of the sheet supply tray to a depth corresponding to the maximum loading number of sheets or more, which may disadvantageously increase a height direction dimension of the sheet supply device. Thus, under such circumstances, it is necessary to choose between limiting the number of sheets to be handled for device size reduction and increasing the number of sheets to be handled at the expense of increased device size.

In view of the above situation, an object of the present invention is to provide a sheet supply device capable of increasing the number of sheets to be loaded without increasing the depth of the sheet supply tray.

Means for Solving the Problems

To solve the above problem, there is provided according to the present invention, a sheet supply device that feeds a sheet placed on a sheet supply tray to a predetermined reading position, the device including a delivery roller that can be freely elevated/lowered and contacts a topmost surface of a sheet bundle on the sheet supply tray to deliver the sheet, an elevating tray that can be freely elevated/lowered and supports a leading end side of the sheet bundle placed on the sheet supply tray, a first drive section that elevates/lowers the elevating tray, a second drive section that elevates/lowers the delivery roller, and a controller that controls drive of the first and second drive sections, wherein when the sheet is fed from the sheet supply tray, the controller controls elevation of the elevating tray through control of the drive of the first drive section and lowering of the delivery roller through control of the drive of the second drive section such that a topmost sheet of the sheet bundle on the sheet supply tray and the delivery roller contact each other.

Further, there is provided according to the present invention, a sheet supply device that feeds a sheet placed on a sheet supply tray to a predetermined reading position, the device including a delivery roller that can be freely elevated/lowered and contacts a topmost surface of a sheet bundle on the sheet supply tray to deliver the sheet, an elevating tray that can be freely elevated/lowered and supports a leading end side of the sheet bundle placed on the sheet supply tray, a first drive section that elevates/lowers the elevating tray, a second drive section that elevates/lowers the delivery roller, a controller that controls drive of the first and second drive sections, and a top surface detection section that detects a position of a topmost surface of the sheet bundle on the sheet supply tray, wherein when the top surface position detection section detects a state where the topmost surface of the sheet bundle on the sheet supply tray is situated below a predetermined position, the controller controls the first and second drive sections so as to elevate the elevating tray until the topmost surface of the sheet bundle on the sheet supply tray reaches the delivery position and thereafter lower the delivery roller to a position where it contacts the topmost surface of the sheet bundle, and when the top surface position detection section detects a state where the topmost surface of the sheet bundle on the sheet supply tray is situated at a predetermined position or above the predetermined position, the controller controls the first and second drive sections so as to lower the delivery roller to a position where it contacts the topmost surface of the sheet bundle with a position of the elevating tray maintained.

The sheet supply device further includes an alignment wall that is fixed to a downstream end of the sheet supply tray and aligns leading ends of a predetermined number of lower side sheets of the sheet bundle placed on the sheet supply tray; and a leading end regulation member that is disposed between the delivery roller and a separation section so as to close a sheet supply port of the sheet supply tray and aligns leading ends of the sheets placed on the sheet supply tray that are not aligned by the alignment wall.

The sheet supply device further includes a releasing section that releases the leading end regulation member from being stopped at a position that regulates leading ends of the sheet bundle placed on the sheet supply tray, wherein the controller controls the releasing section to release the stop state when lowering the delivery roller.

Advantages of the Invention

According to the sheet supply device of the present invention, by adopting a configuration in which the elevating tray and the delivery roller are independently elevation-controlled, the document can be set in a state where the delivery roller is retreated, whereby it is possible to increase the number of sheets to be loaded on the sheet supply tray by the retreated amount without increasing the depth of the sheet supply tray.

BEST MODE FOR CARRYING OUT THE INVENTION

A sheet supply device according to the present invention will be described below with reference to the drawings. Hereinafter, a configuration will be described, in which a document reading device provided with two reading sections for reading a double side document with images formed on both sides thereof is constituted by a document reading device main body H and a document conveying device A to which a sheet supply device of the present invention is applied.

Figure 1:
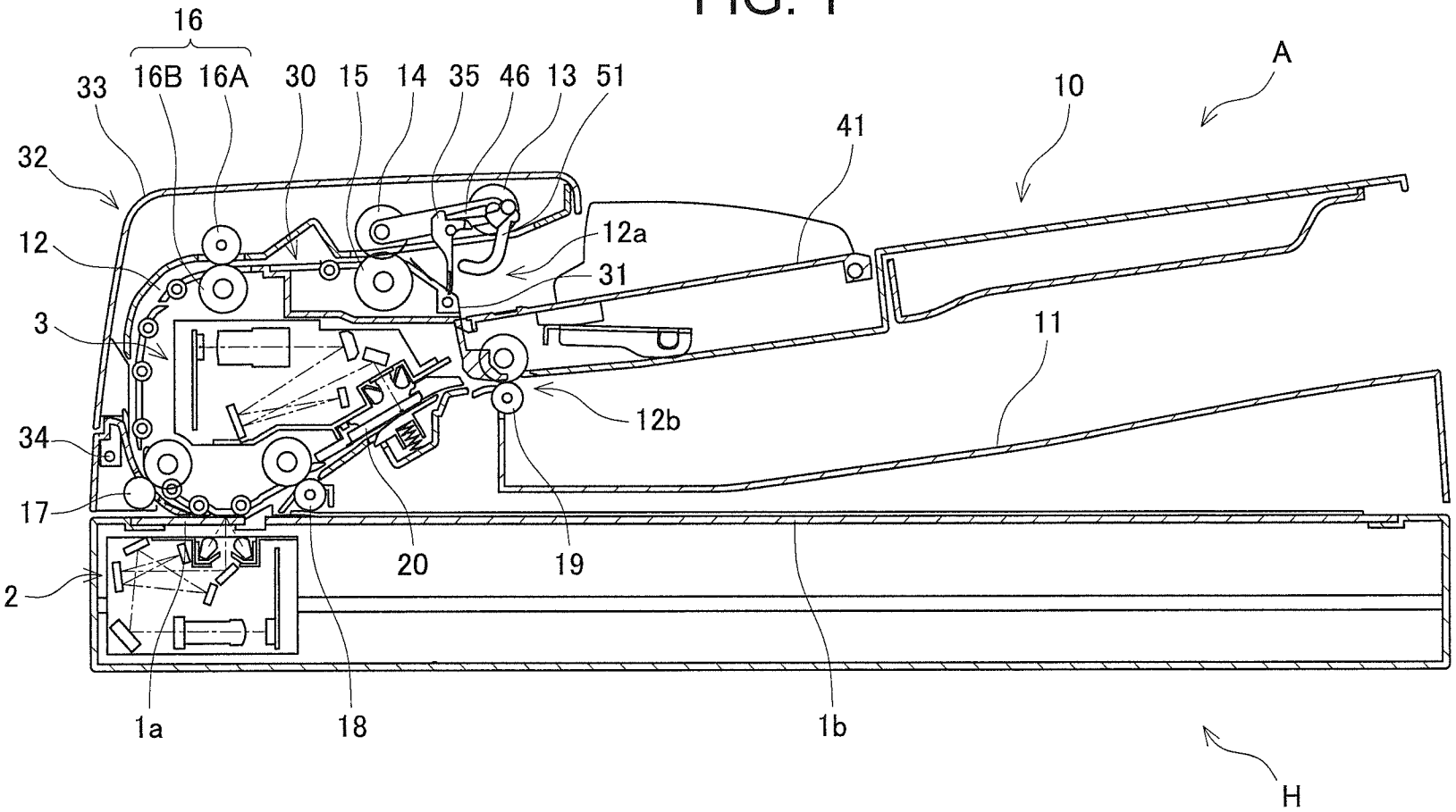
FIG. 1 is a cross-sectional view illustrating an entire configuration of a document reading device provided with a sheet supply device according to the present invention.

FIG. 1 is a cross-sectional view illustrating an entire configuration of a document reading device provided with a sheet supply device according to the present invention. As illustrated in FIG. 1, the document reading device includes a document reading device main body H and a document conveying device A that conveys a document. The document conveying device A is mounted to the document reading device main body H through a not illustrated hinge. The document conveying device A is supported by the hinge so as to be openable/closable with respect to an upper surface of the document reading device main body H.

The document reading device main body H incorporates a first reading section 2 that reads one side of a document (sheet) conveyed on an upper surface of a contact glass 1*a* by the document conveying device A. The document conveying device A incorporates a second reading section 3 that reads the other side of the document that has passed through the upper surface of the contact glass 1*a* of the main body H.

The document conveying device A is openably/closably mounted to the document reading device main body H so as to expose an upper surface of the main body H, and a document which is placed on a contact glass 1*b* of the main body H is read with the first reading section 2 being moved.

The first reading section 2 incorporated in the document reading device main body H integrally includes a photoelectric conversion means including a light source, a plurality of mirrors, a lens, and a photoelectric conversion element (CCD). The first reading section 2 irradiates a conveyed document through the first contact glass 1*a* with light from the light source. Light reflected from the document is reflected by the mirrors and then enters the photoelectric conversion means including the CCD through the lens, where the light is subjected to photoelectric conversion for document image reading. Further, the first reading section 2 moves in a sub-scanning direction to thereby read an image of a thick document such as a book placed on the second contact glass 1*b* through opening/closing operation of the document conveying device A.

As illustrated in FIG. 1, the document conveying device A has a sheet supply tray 10 on which a plurality of documents can be placed and a sheet discharge tray 11 that houses the read document. The sheet supply tray 10 is disposed above the sheet discharge tray 11 in an overlapping manner. There are provided, on a downstream side of the sheet supply tray 10, an elevating tray 41 that supports a downstream side of the document placed on the sheet supply tray 10 and an alignment wall 31 that aligns downstream side leading ends of the documents placed on the sheet supply tray 10.

A document conveying path 12 is a U-shaped path extending from the sheet supply tray 10 up to the sheet discharge tray 11. The document conveying path 12 includes, as illustrated in FIG. 1, an upstream side path extending from a sheet supply port 12*a* through which the document on the sheet supply tray 10 is delivered up to a resist roller pair 16, a curved intermediate path extending, while curving, from the resist roller pair 16 to the first contact glass 1*a*, and a downstream side path extending from the first contact glass 1*a* up to a sheet discharge port 12*b* at which a discharge roller pair 19 is disposed. The document conveying path 12 is formed by a conveying guide member arranged on upper and lower sides thereof.

Along the document conveying path 12, there are provided a delivery roller 13 that abuts against the document placed on the sheet supply tray 10 with its leading end aligned by the alignment wall 31 and thereby delivers the document, a feeding roller 14 that feeds the document delivered by the delivery roller 13, a separation roller (separation member) 15 that is brought into pressure contact with the feeding roller 14 so as to feed the document one by one, a resist roller pair (resist rollers 16A and 16B) 16 that receives an abutment of the leading end of the document fed by a separation means including the feeding roller 14 and the separation roller 15 for alignment and then feeds the document downstream, a carry-in roller pair 17 disposed upstream of the first contact glass 1*a*, a carry-out roller pair 18 disposed downstream of the first contact glass 1*a*, and a discharge roller pair 19 disposed downstream of the carry-out roller pair 18 and discharges the document to the sheet discharge tray 11.

The delivery roller 13, the feeding roller 14, and the resist roller 16A are unitized with a sheet feed cover 33 of the document conveying device A and a part of the outer conveying guide member at an upstream side of the document conveying path 12 to constitute a sheet feed cover unit 32. Further, the separation roller 15 and alignment wall 31 of the sheet supply tray 10 are unitized with a part of the inner conveying guide member at the upstream side of the document conveying path 12 to constitute a separation guide unit 30.

The document conveying device A incorporates the second reading section 3 that reads a side of the document opposite to a side thereof read by the first reading section 2. The second reading section 3 is disposed inside the U-shaped document conveying path 12. The second reading section 3 has a third contact glass 20 at its end portion in a sheet discharge direction. The third contact glass 20 is disposed between the carry-out roller pair 18 and the discharge roller pair 19. One surface of the third contact glass 20 functions as a part of the conveying guide member of the document conveying path 12. With this configuration, the second reading section 3 reads the document passing through the surface of the third contact glass 20.

In a double-side reading mode, the document on the sheet supply tray 10 is delivered by the delivery roller 13 and fed one by one by the feeding roller 14 and the separation roller 15 (separation means). The fed one document is aligned by the resist roller pair 16 and conveyed to the first contact glass 1*a* by the carry-in roller pair 17. Thereafter, the document that has passed through the first contact glass 1*a* is conveyed to the third contact glass 20 by the carry-out roller pair 18 and discharged to the sheet discharge tray 11 by the discharge roller pair 19. In this conveyance process, a front surface of the document is read by the first reading section when the document passes through the first contact glass 1*a*, and a rear surface of the document is read by the second reading section 3 when the document passes through the third contact glass 20.

Figure 2:
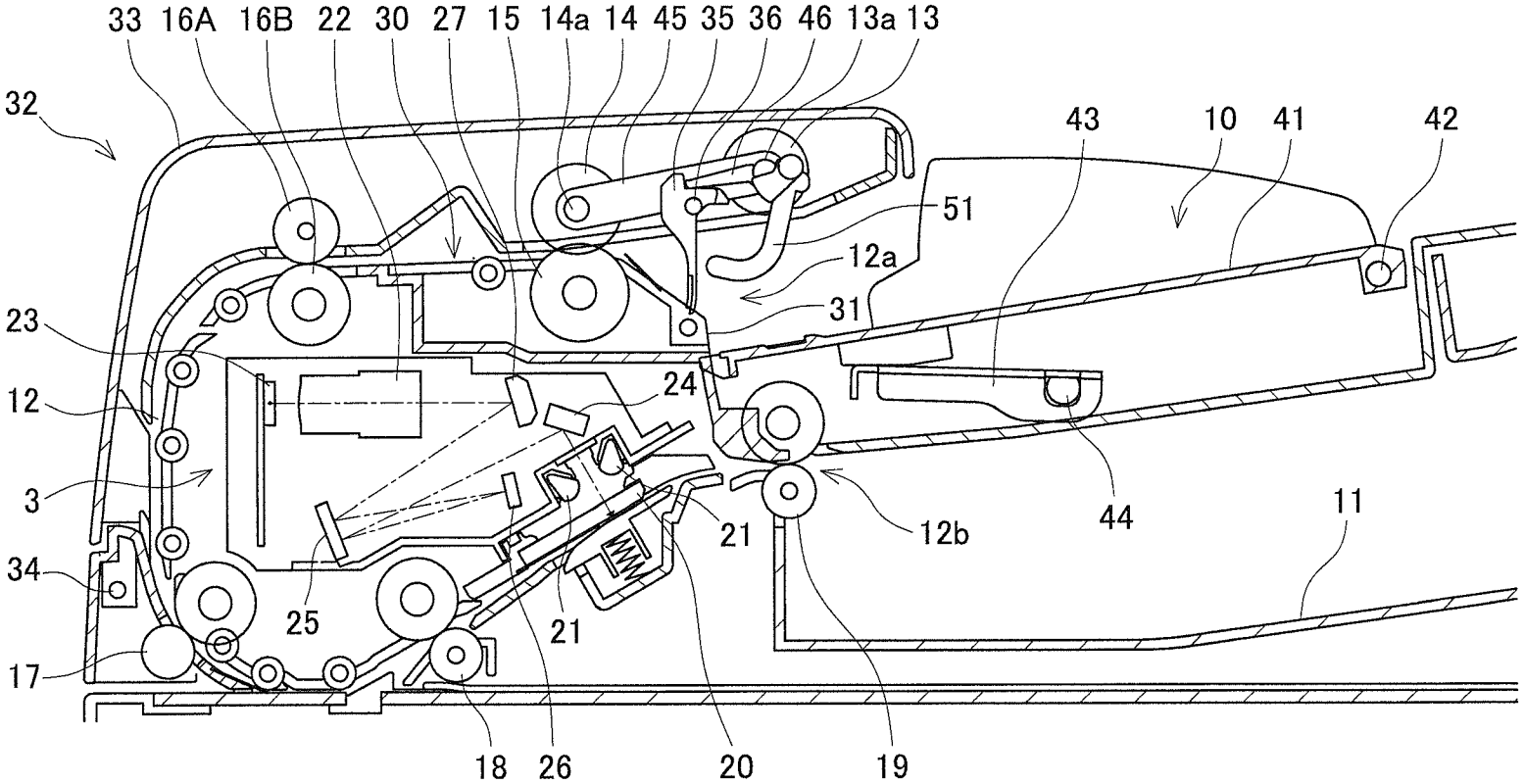
FIG. 2 is a partially enlarged view of the document reading device of FIG. 1.

The following describes a configuration of the second reading section 3. FIG. 2 is a partially enlarged view of the document conveying device A of FIG. 1. As illustrated in FIG. 2, the second reading section 3 includes a light source 21 having an LED for irradiating the document passing through the contact glass 20 with light and a light guide body, a plurality of mirrors 24, 25, 26, and 27 that lead reflected light from the document in a predetermined direction, a lens 22 that converges the reflected light led by the plurality of mirrors 24, 25, 26, and 27, and a CCD (photoelectric conversion element) 23 that photoelectric-converts the light converged by the lens 22.

The second reading section 3 irradiates the document through the third contact glass 20 with light emitted from the light source 21. Light reflected from the document is reflected by the mirrors 24, 25, 26, and 27 and then enters the CCD 23 through the lens. 22, where the light is subjected to photoelectric conversion for document image reading.

The following describes the sheet feed cover unit 32 and the separation guide unit 30. As illustrated in FIGS. 1 and 2, the document conveying device A is provided with the sheet feed cover 33 that covers the sheet supply port 12*a*, the document conveying path 12, the second reading section 3, and the like. The sheet feed cover 33 is formed integrally with the delivery roller 13, the feeding roller 14, the resist roller 16A, and an upper part of conveying guide member at an upstream to intermediate part of the document conveying path 12 to thereby constitute the sheet feed cover unit 32. The sheet feed cover unit 32 is turnably supported by the document conveying device A with a hinge 34 so as to be openable/closable, and it is possible to expose the upstream side of the document conveying path 12 by turning upward the sheet feed cover unit 32.

On the other hand, inside the sheet feed cover unit 32, the separation guide unit 30 having inside thereof the separation roller 15 is provided. The separation guide unit 30 is detachably disposed at an upper portion of the second reading section 3 and is fixed from above to a device side plate by screws.

As illustrated in FIGS. 1 and 2, an outer surface of the separation guide unit 30 on the sheet supply port 12*a* side functions as the alignment wall 31 for aligning the leading ends of the documents placed on the sheet supply tray 10. Further, an upper surface of the separation guide unit 30 constitutes the inner conveying guide member at the upstream side of the document conveying path 12.

Figure 3:
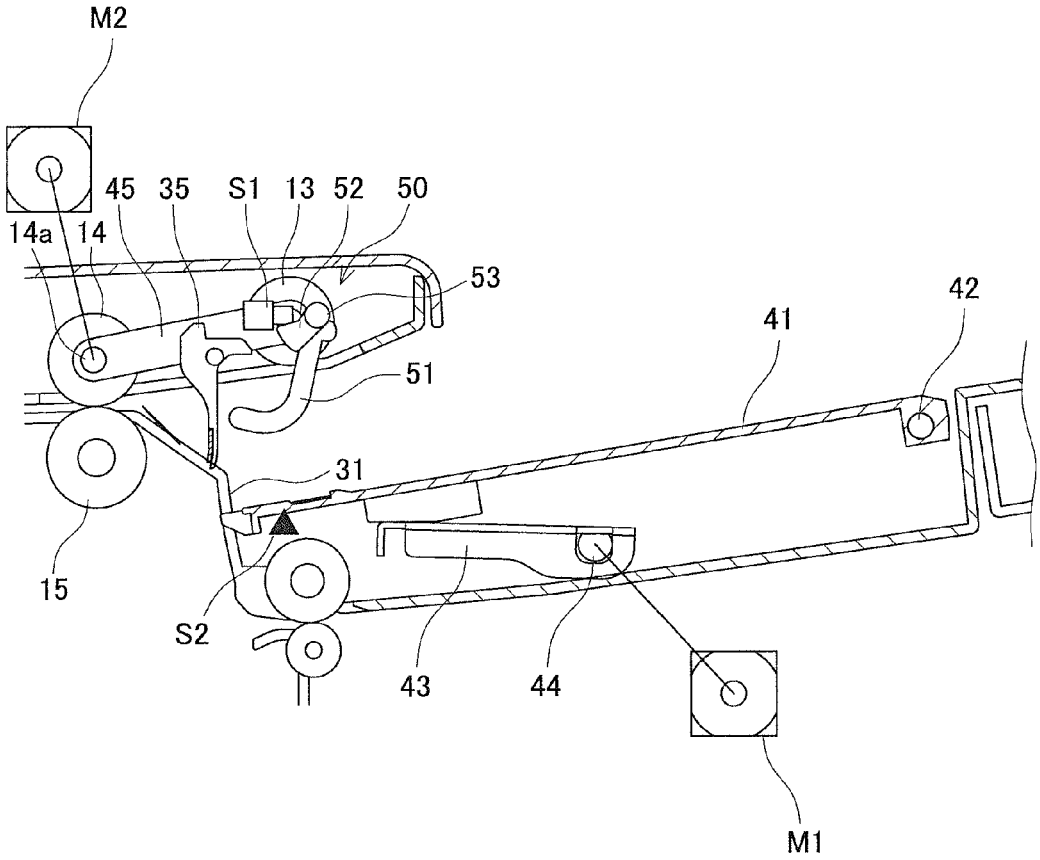
FIG. 3 is an exemplary view schematically illustrating a configuration of a sheet feed section in the document reading device of FIG. 1.
Figure 4:
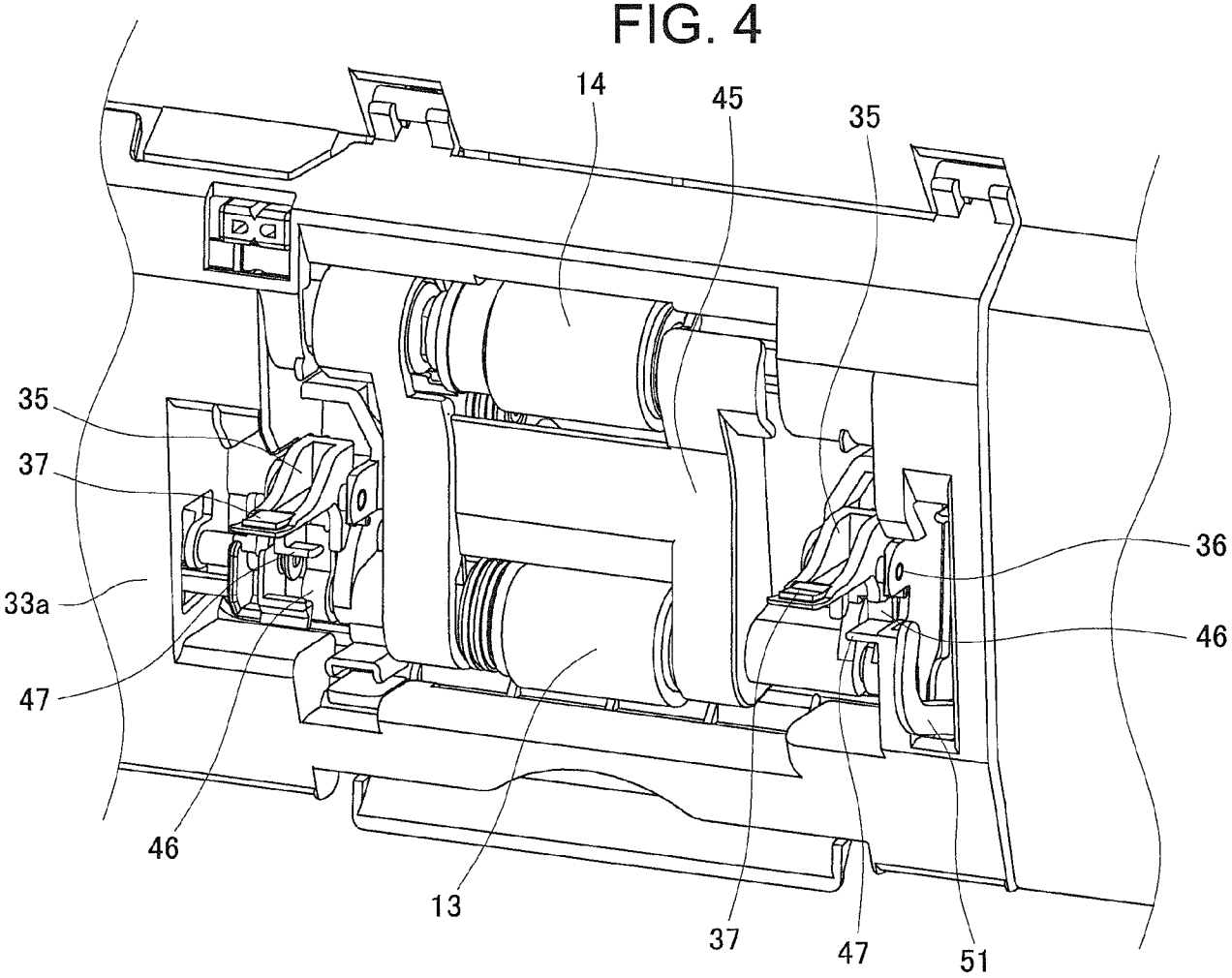
FIG. 4 is a perspective view of an area in the vicinity of a delivery roller of the document reading device of FIG. 1, as viewed from below.

The following describes an outline of a configuration of a sheet feed section that feeds the document on the sheet supply tray 10 to the conveying path 12 with reference to FIGS. 2 to 4. FIG. 3 is an exemplary view schematically illustrating a configuration of the sheet feed section, and FIG. 4 is a perspective view of an area in the vicinity of the delivery roller 13 as viewed from below.

A swing arm 45 that rotatably supports a drive shaft 13*a* of the delivery roller 13 is disposed in the sheet supply port 12*a*. The swing arm 45 is further connected to a drive shaft 14*a* of the feeding roller 14 through a torque limiter and is configured to swing with rotation of the drive shaft 14*a*. The drive shaft 14*a* of the feeding roller 14 is connected to a feeding motor M2. When the feeding motor M2 rotates forward or backward, the swing arm 45 swings by receiving a drive force from the drive shaft 14*a* to thereby elevate the delivery roller 13. With the above configuration, the delivery roller 13 can move between a sheet feed position where the document placed on the sheet supply tray 10 is delivered and a retreat position located above the sheet feed position.

Specifically, when the feeding motor M2 is rotated forward, the drive shaft 14*a* of the feeding roller 14 rotates in a sheet feed direction. Accordingly, the swing arm 45 swings in a direction approaching the elevating tray 41 (i.e., swings downward) to lower the delivery roller 13. When the delivery roller 13 contacts a topmost surface of the document bundle placed on the elevating tray 41, transmission of the drive force from the drive shaft 14*a* to the swing arm 45 is interrupted by action of the torque limiter, with the result that the swing of the swing arm 45 is stopped, and the delivery roller 13 is stopped in a state of abutting against the topmost surface of the document bundle.

On the other hand, when the feeding motor M2 is rotated backward, the drive shaft 14*a* of the feeding roller 14 rotates in a direction opposite to the sheet feed direction. Accordingly, the swing arm 45 swings in a direction separating from the elevating tray 41 (i.e., swings upward) to elevate the delivery roller 13. Then, the swing arm 45 that has swung upward abuts against a not illustrated regulation piece, with the result that the swing of the swing arm 45 is stopped by action of the torque limiter, and the delivery roller 13 is also stopped.

The separation roller 15 is a roller that is brought into pressure contact with the feeding roller 14 to separate the documents one from the other and constitutes, together with the feeding roller 14, the separation means. The separation means separates the documents delivered from the delivery roller 13 one from the other.

A stopper (leading end regulation member) 35 is disposed between the delivery roller 13 and separation means (feeding roller 14 and separation roller 15) so as to close the sheet supply port 12*a*. The stopper 35 is turnable about a shaft 36 mounted to an inner frame 33*a* of the sheet feed cover 33 and aligns downstream side leading ends of the documents placed on the elevating tray 41 that are located at a position exceeding a height of the alignment wall 31. Further, the stopper 35 allows passage of the document therethrough only when the delivery roller 13 delivers the document.

Figure 5A:
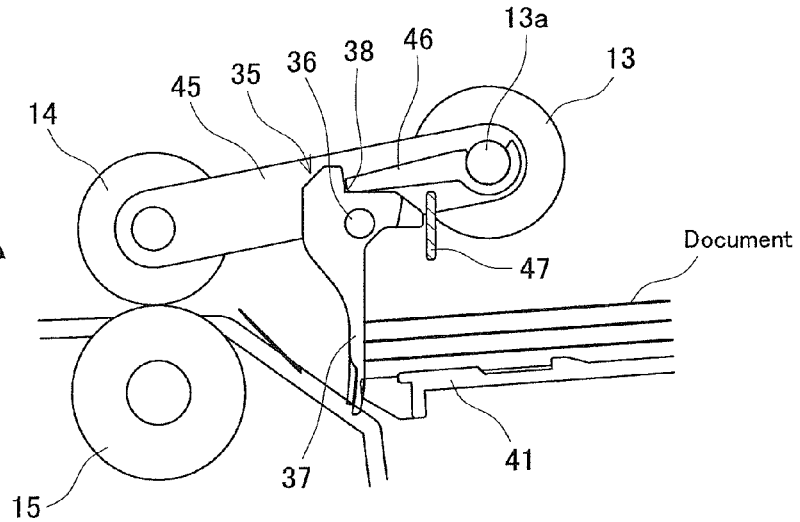
FIGS. 5A to 5C are exemplary views for explaining a configuration of a stopper of the sheet supply device according to the present invention.
Figure 5B:
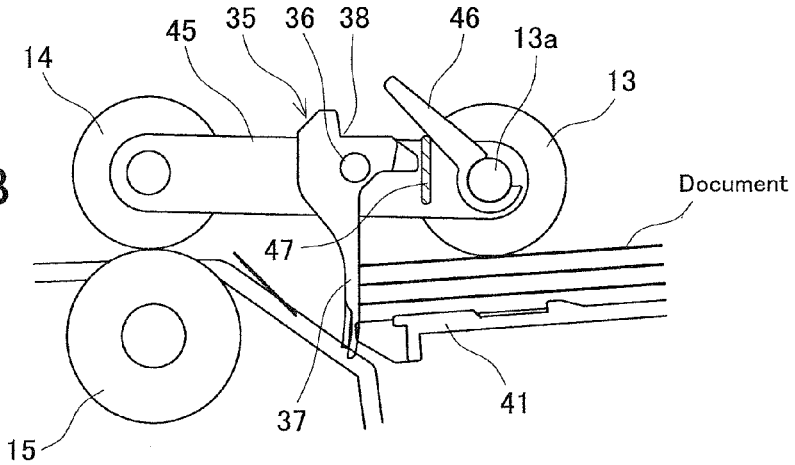
Figure 5C:
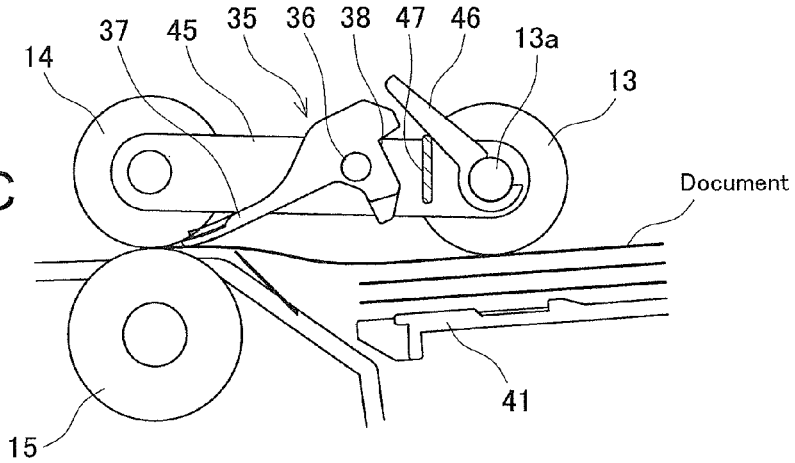

FIGS. 5A to 5C are exemplary views for explaining a configuration and an operation of the stopper 35. FIG. 5A illustrates a state where the elevating tray 41 is elevated to the delivery position and the delivery roller 13 is situated at the retreat position. FIG. 5B illustrates a state where the delivery roller 13 is lowered to the sheet feed position to release the regulated state of the stopper 35 by a locking piece 46 (releasing means). FIG. 5C illustrates a state where the stopper 35 that has been brought into a swingable state after release of the regulation is swung by a leading end of the delivered document. As illustrated in FIGS. 5A to 5C, the stopper 35 is a substantially L-shaped member elongated downward and has a long part 37 configured to be swingable about the shaft 36. On an opposite side to the long part 37, an engagement portion 38 engaged with the locking piece 46 is formed. On the other hand, the locking piece 46 is connected to the drive shaft 13*a* of the delivery roller 13 so as to be rotatable relative to the drive shaft 13*a*. Further, a projection portion 47 for regulating movement of the locking piece 46 is formed so as to project from the inner frame 33*a* of the sheet feed cover 33.

As illustrated in FIG. 5A, when the delivery roller 13 is situated at the retreat position, a leading end of the locking piece 46 abuts against the engagement portion 38 of the stopper 35. While the locking piece 46 abuts the engagement portion 38, the stopper 35 is regulated in movement and thus cannot swing in the sheet feed direction. Thus, in this state, the stopper 35 aligns downstream side leading ends of the documents placed on the elevating tray 41 that are located at a position exceeding a height of the alignment wall 31.

On the other hand, as illustrated in FIG. 5B, when the delivery roller 13 is lowered from the retreat position, the locking piece 46 that is lowered with the lowering of the delivery roller 13 collides with the projection portion 47 projecting from the inner frame 33*a* of the sheet feed cover 33 to turn upward. As a result, the locking piece 46 is disengaged from the engagement portion 38 of the stopper 35, and the stopper 35 is released from a locked state to become freely swingable. It follows that, as illustrated in FIG. 5C, the document delivered by the delivery roller 13 can pass through the sheet supply port 12*a* while swinging the stopper 35.

The elevating tray 41 provided on a downstream side of the sheet supply tray 10 is configured to be turnable about a turning supporting point 42 provided at an upstream side end portion thereof. The elevating tray 41 can turn from a set position where the document is set to a delivery position where the topmost surface of the document bundle placed on the elevating tray 41 abuts against the delivery roller 13.

An elevating lever 43 for elevating or lowering the elevating tray 41 is disposed at a lower portion of the elevating tray 41. The elevating lever 43 is configured to be turnable about a shaft 44 and is connected to an elevating motor M1 to be subjected to turning control. When being turned upward, the elevating lever 43 pushes upward a downstream side of the elevating tray 41 to elevate the elevating tray 41. On the other hand, when the elevating lever 43 is turned downward, the pushed up elevating tray 41 is correspondingly lowered.

Figure 9:
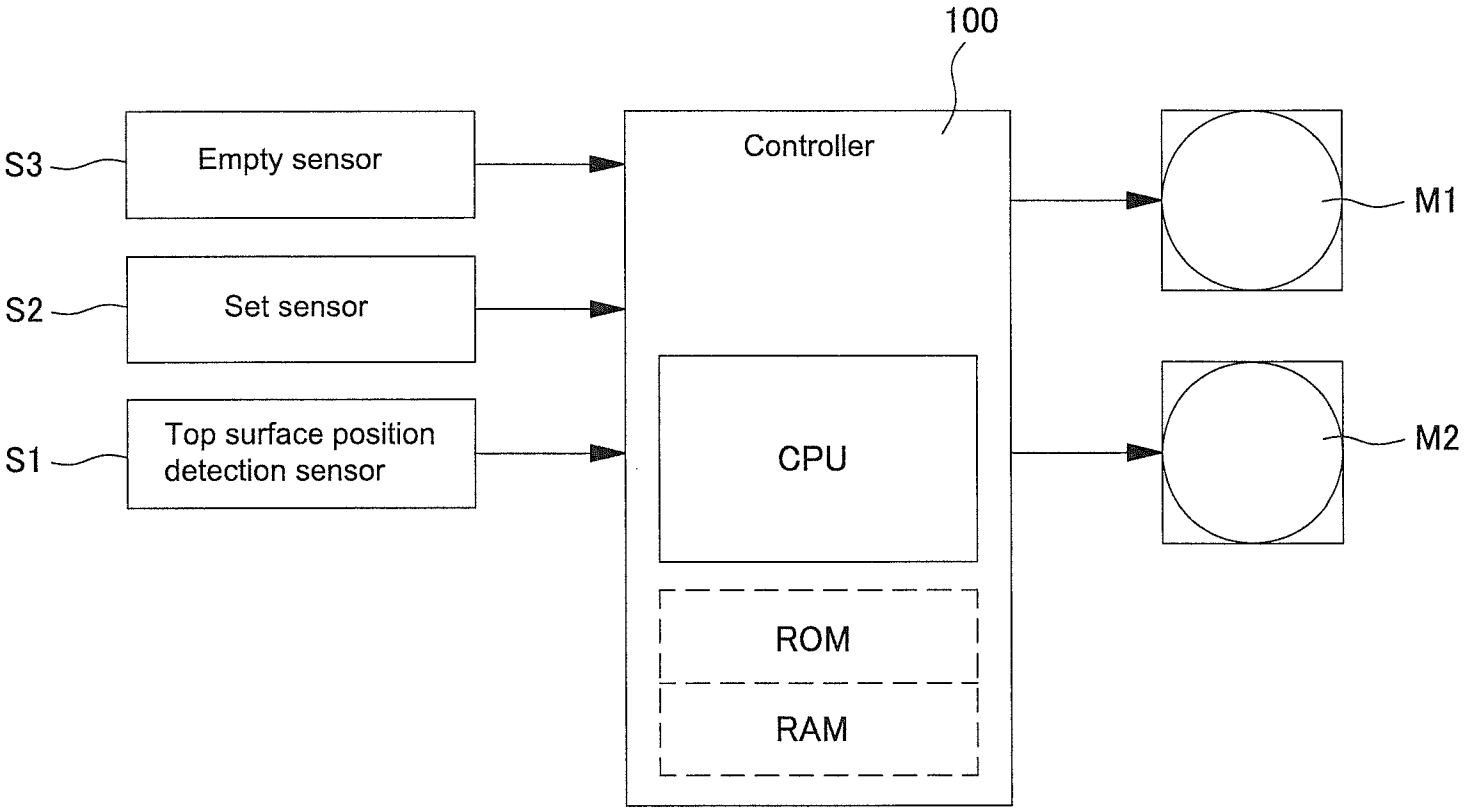
FIG. 9 is a block diagram illustrating a control system of the sheet supply device according to the present invention.

A set sensor S2 that detects the document being set on the elevating tray 41 is disposed on the downstream side of the elevating tray 41. Further, there are disposed above the elevating tray 41, an empty sensor that detects the document being placed on the sheet supply tray 10 and a top surface position detection sensor S1 that detects a top surface position of the placed document bundle. As illustrated in a control block diagram of FIG. 9, the sensors S1 to S3 are each connected to a controller (control means) 100 provided with a CPU that controls drive of the entire device according to a control program, a ROM that stores the control program, and a RAM. The controller controls drive of the motors M1 and M2 based on a detection signal from each sensor.

A top surface detection means 50 is provided in the sheet feed section so as to move the topmost surface of the document bundle placed on the elevating tray 41 to the delivery position to stop the turning of the elevating tray 41. The top surface detection means 50 includes a top surface position detection lever 51 suspended so as to be swingable about a shaft 53, a detection flag 52 formed integrally with the top surface position detection lever 51 and configured to swing following the swing of the top surface position detection lever 51, and the top surface position detection sensor S1 that detects the detection flag 52. The top surface position detection sensor S1 is configured to detect the detection flag 52 when the top surface position detection lever 51 turns by a predetermined amount. The top surface position detection sensor S1 includes, e.g., a transmission-type sensor having a light-emitting section and a light-receiving section and detects the detection flag 52 based on interruption of light emitted from the light-emitting section to the light-receiving section.

The top surface detection means 50 detects the topmost surface of the document bundle as follows. The top surface position detection lever 51 is swingably suspended at a position above the elevating tray 41 and, when the topmost surface of the document bundle placed on the elevating tray 41 is situated at a predetermined delivery position, the top surface position detection lever 51 and the topmost surface of the document bundle abut against each other, so that the top surface position detection lever 51 turns about the shaft 53. At this time, the detection flag 52 also turns with the turning of the top surface position detection lever 51. Then, the top surface position detection sensor S1 detects the detection flag 52, and thus it is determined that the topmost surface of the document bundle placed on the elevating tray 41 is situated at the predetermined delivery position.

Figure 6:
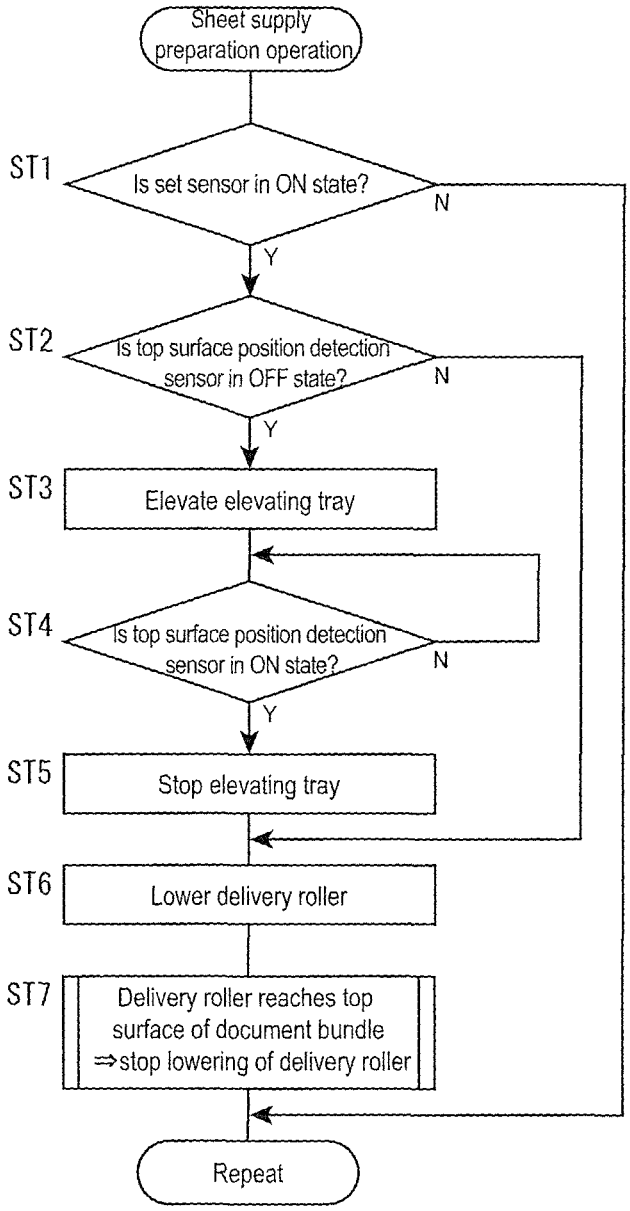
FIG. 6 is a flowchart for explaining a sheet supply preparation operation performed in the sheet supply device according to the present invention.
Figure 7A:
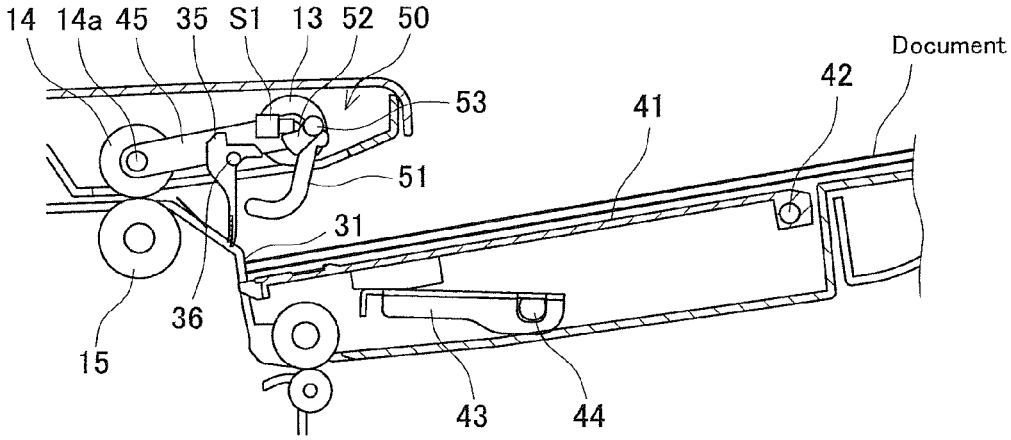
FIGS. 7A to 7C are exemplary views (in a first case) for explaining a state of the sheet feed section in the sheet supply preparation operation performed in the sheet supply device according to the present invention.
Figure 7B:
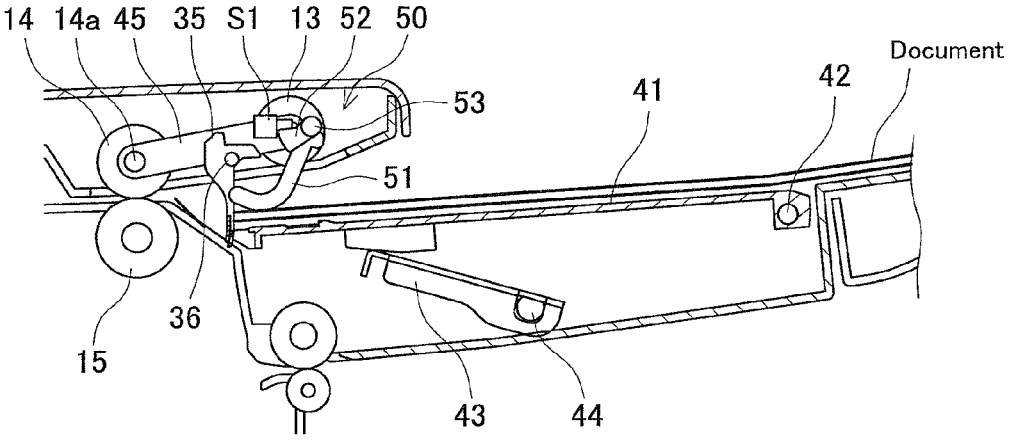
Figure 7C:
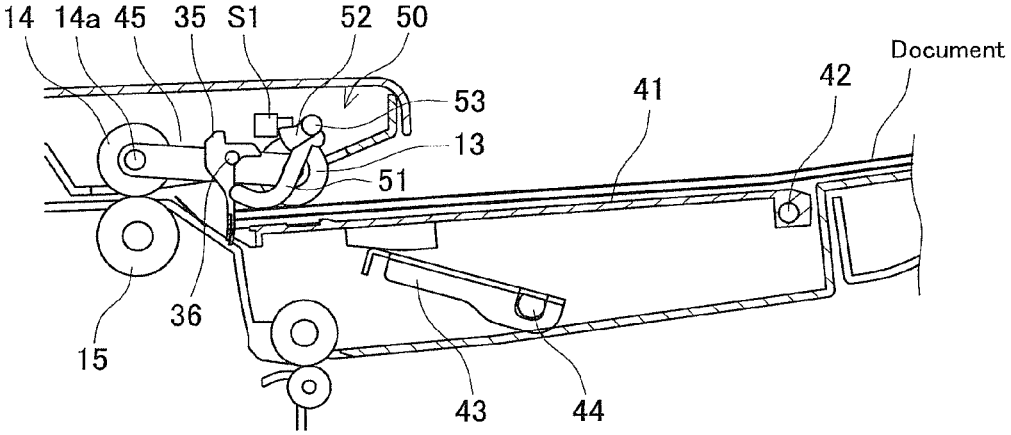

The following describes, with reference to a flowchart of FIG. 6, a sheet supply preparation operation that uses the top surface detection means 50 to position the document bundle at the delivery position. FIGS. 7A to 7C and 8A to 8B are exemplary views each illustrating a state of the sheet feed section in the sheet supply preparation operation.

First, in step ST1, when the set sensor S2 detects the document bundle on the elevating tray 41 and is thus tuned ON, detection of the top surface position of the document bundle is started. That is, in step ST2, a state of the top surface position detection sensor S1 is checked. When the top surface position detection sensor S1 is in an OFF state, it is determined that the topmost surface of the sheet bundle is situated below the delivery position.

When it is determined in step ST2 that the top surface position detection sensor S1 is in OFF, i.e., the topmost surface of the sheet bundle is situated below the delivery position (see FIG. 7A), the elevating motor M1 is forward-driven to elevate the elevating tray 41 in step ST3. Then, the upper surface of the document bundle on the elevating tray 41 is elevated to abut against and turn the top surface position detection lever 51. Correspondingly, the detection flag 52 turns upward and is thus detected by the top surface position detection sensor 51 (step ST4). Accordingly, it is determined that the topmost surface of the document bundle has reached the delivery position, and in step ST5, the elevating motor M1 is stopped to stop elevation of the elevating tray 41 (see FIG. 7B).

Then, in step ST6, the feeding motor M2 is forward-driven to lower the delivery roller 13 to cause the same to abut against the topmost surface of the document bundle. When the delivery roller 13 abuts against the topmost surface of the document bundle, the lowering of the delivery roller 13 is stopped by the action of the torque limiter as described above (step ST7, see FIG. 7C). Thus, preparation for delivery of the document is completed, thus enabling the document delivery operation.

Figure 8A:
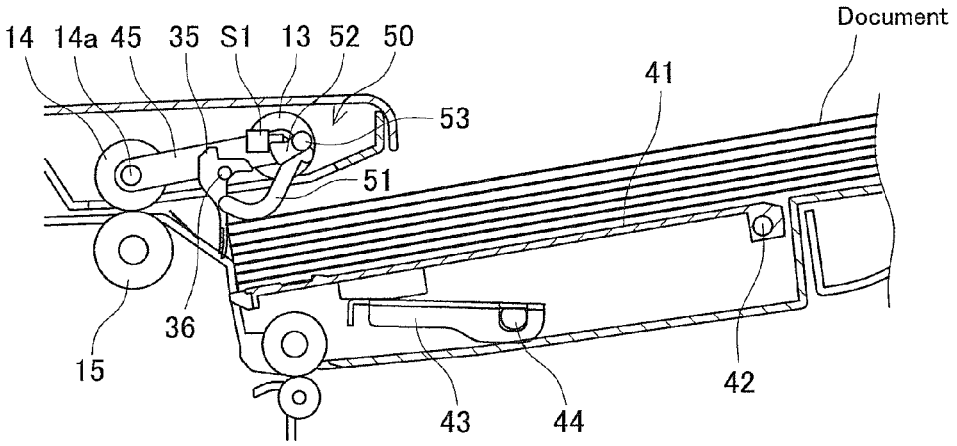
FIGS. 8A to 8B are exemplary views (in a second case) for explaining a state of the sheet feed section in the sheet supply preparation operation performed in the sheet supply device according to the present invention.
Figure 8B:
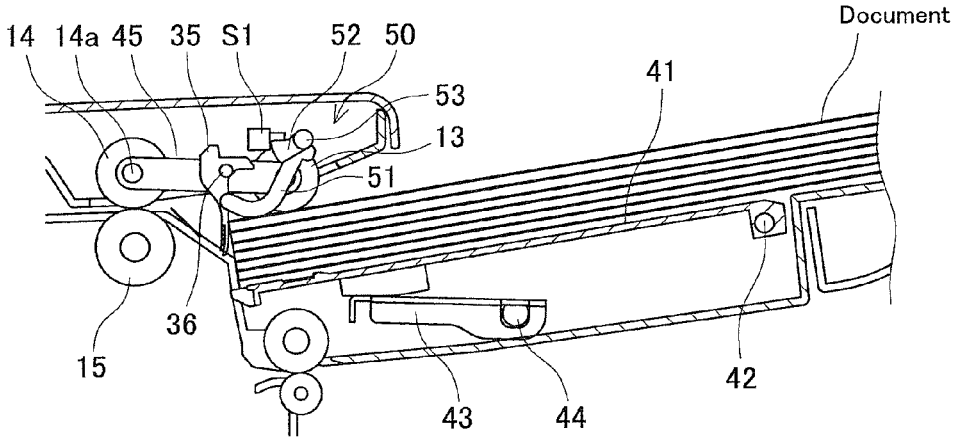

On the other hand, when the top surface position detection sensor S1 is in an ON state in step ST2, it is determined that the topmost surface of the document bundle is situated at the delivery position or that the number of the set documents is near the maximum loading number of sheets and, thus, the topmost surface of the document bundle is situated above the delivery position (see FIG. 8A). In this case, the elevating tray 41 is not elevated, but in step S6, the feeding motor M2 is forward-driven to lower the delivery roller to cause the same to abut against the top surface of the document bundle (see FIG. 8B). With this configuration, the document can be delivered quickly.

Since the delivery roller 13 is rotated by the drive of the feeding motor M2 at a time point when contacting the top surface of the document bundle, the document can be delivered simultaneously with contact of the delivery roller 13 with the top surface of the document bundle.

As described above in detail, according to the sheet supply device of the present invention, by adopting a configuration in which the elevating tray and the delivery roller are independently elevation-controlled, the document can be set in a state where the delivery roller is retreated, whereby it is possible to increase the number of sheets to be loaded on the sheet supply tray by the retreated amount without increasing the depth of the sheet supply tray.

REFERENCE SIGNS LIST

10: Sheet supply tray
12*a:* Sheet supply port
13: Delivery roller
14: Feeding roller (separation means)
14*a:* Drive shaft
15: Separation roller (separation means)
31: Alignment wall
35: Stopper (leading end regulation member)
36: Shaft
38: Engagement portion
41: Elevating tray
42: Turning supporting point
43: Elevating lever
44: Shaft
45: Swing arm
46: Locking piece (releasing means)
47: Projection portion
50: Top surface position detection means
51: Top surface position detection lever
52: Detection flag
53: Shaft
M1: Elevating motor
M2: Feeding motor
S1: Top surface position detection sensor

The invention claimed is:

1. A sheet supply device comprising:

a sheet supply tray on which a sheet bundle to be fed is placed;

a delivery roller that can be freely elevated or lowered and contacts a topmost surface of the sheet bundle on the sheet supply tray to deliver a topmost sheet of the sheet bundle;

an elevating tray that can be freely elevated or lowered and supports a leading end side of the sheet bundle placed on the sheet supply tray;

a first drive section that elevates or lowers the elevating tray;

a second drive section that elevates or lowers the delivery roller;

a controller that controls drive of the first and second drive sections; and a top surface detection device having a top surface position detection lever swingably arranged above the elevating tray and contacting the topmost surface of the sheet bundle to detect a position of the topmost surface of the sheet bundle on the sheet supply tray, wherein in feeding the sheet from the sheet supply tray, when the top surface detection device detects a state wherein the topmost surface of the sheet bundle on the sheet supply tray is positioned below a delivery position to feed the topmost sheet toward a downstream side of the elevating tray, the controller controls the first drive section and the second drive section to elevate the elevating tray until the topmost surface of the sheet bundle on the sheet supply tray reaches the delivery position and thereafter, to lower the delivery roller to a position to contact the topmost surface of the sheet bundle.

2. The sheet supply device according to claim 1, further comprising:

an alignment wall that is fixed to a downstream end of the sheet supply tray and aligns leading ends of a predetermined number of lower side sheets of the sheet bundle placed on the sheet supply tray; and a leading end regulation member that is disposed between the delivery roller and a separation section arranged on a downstream side of the delivery roller so as to cover a sheet supply port of the sheet supply tray and aligns leading ends of the sheet bundle placed on the sheet supply tray that are not aligned by the alignment wall.

3. The sheet supply device according to claim 2, wherein the leading end regulation member includes a regulation surface disposed parallel to a regulation wall of the alignment wall aligning the leading ends of the sheet bundle, and the regulation surface is disposed on a downstream side of the top surface position detection lever and in a vicinity of a downstream end of the regulation wall, in a sheet feed direction.

4. The sheet supply device according to claim 2, further comprising a locking piece rotatably coaxially arranged on a rotating shaft of the delivery roller, and a projection portion disposed between the locking piece and the leading end regulation member, wherein the leading end regulation member has a long part formed at one end portion thereof and an engagement portion formed at another end portion thereof, when the delivery roller is positioned apart from the topmost surface of the sheet bundle, a leading end portion of the locking piece is engaged with the engagement portion to regulate rotation of the leading end regulation member, thereby the sheet bundle stays on the sheet supply tray through the long part, and when the delivery roller is lowered and contacts the topmost surface of the sheet bundle, the projection portion pushes the locking piece to rotate in a direction to release the locking piece from being engaged, thereby the leading end regulation member is rotated such that the topmost sheet of the sheet bundle is fed toward a downstream side of the leading end regulation member in the sheet feed direction.

5. The sheet supply device according to claim 1, further comprising:

a leading end regulation member that is disposed between the delivery roller and a separation section arranged on a downstream side of the delivery roller to cover a sheet supply port of the sheet supply tray; and a releasing section that releases the leading end regulation member from being stopped at a position that regulates leading ends of the sheet bundle placed on the sheet supply tray, wherein the controller controls the releasing section to release the leading end regulation member from being stopped when lowering the delivery roller.

6. The sheet supply device according to claim 1, further comprising a set sensor arranged on the sheet supply tray and detecting the sheet bundle set on the sheet supply tray, wherein the controller controls the drive of the first and second drive sections based on a detection state of the set sensor.

7. The sheet supply device according to claim 1, wherein the top surface detection device further includes a detection flag integrally formed with the top surface position detection lever to swing together with the top surface position detection lever, and a top surface detection sensor detecting the detection flag.

8. A sheet supply device comprising:

a sheet supply tray on which a sheet bundle to feed is placed;

a delivery roller that can be freely elevated or lowered and contacts a topmost surface of the sheet bundle on the sheet supply tray to deliver a topmost sheet of the sheet bundle;

an elevating tray that can be freely elevated or lowered and supports a leading end side of the sheet bundle placed on the sheet supply tray;

a first drive section that elevates or lowers the elevating tray;

a second drive section that elevates or lowers the delivery roller;

a controller that controls drive of the first and second drive sections; and a top surface detection device having a top surface position detection lever swingably arranged above the elevating tray and contacting the topmost surface of the sheet bundle to detect a position of the topmost surface of the sheet bundle on the sheet supply tray, wherein when the top surface position detection device detects a state wherein the topmost surface of the sheet bundle on the sheet supply tray is positioned below a delivery position to feed the topmost sheet toward a downstream side of the elevating tray, the controller controls the first and second drive sections so as to elevate the elevating tray until the topmost surface of the sheet bundle on the sheet supply tray reaches the delivery position and thereafter, to lower the delivery roller to a position to contact the topmost surface of the sheet bundle, and when the top surface position detection device detects a state wherein the topmost surface of the sheet bundle on the sheet supply tray is positioned at the delivery position or above the delivery position, the controller controls the first and second drive sections so as to lower the delivery roller to the position to contact the topmost surface of the sheet bundle with maintaining a position of the elevating tray.

* * * * *